US005938188A

United States Patent [19]

Nagahara

[11] Patent Number: 5,938,188

[45] **Date of Patent: *Aug. 17, 1999**

[54] SHEET FEEDING APPARATUS WITH ADJUSTMENT OF PRESSURE BETWEEN SHEET CONVEY MEANS AND SHEET SEPARATION MEMBER

[75] Inventor: Hideaki Nagahara, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/386,769

[22] Filed: Feb. 10, 1995

[30] Foreign Application Priority Data

Feb. 15, 1994 [JP] Japan ..... 6-039325

[51] Int. Cl.[6] ..... B65H 3/52

[52] U.S. Cl. ..... 271/121; 271/124

[58] Field of Search ..... 271/121, 124, 271/125, 162, 164, 126, 127

[56] References Cited

U.S. PATENT DOCUMENTS

| | | | |
|---|---|---|---|
| 4,526,358 | 7/1985 | Ura et al. | 271/124 X |
| 4,922,291 | 5/1990 | Adachi | 355/72 |
| 5,201,511 | 4/1993 | Kim | 271/127 |
| 5,232,214 | 8/1993 | Matsuura et al. | 271/121 X |
| 5,470,052 | 11/1995 | Asakawa et al. | 271/125 X |

FOREIGN PATENT DOCUMENTS

| | | | |
|---|---|---|---|
| 0204227 | 12/1986 | European Pat. Off. . | |
| 0629073 | 12/1994 | European Pat. Off. . | |
| 104844 | 6/1983 | Japan | 271/121 |
| 56227 | 3/1987 | Japan | 271/121 |
| 249842 | 10/1987 | Japan | 271/121 |
| 62335 | 3/1990 | Japan | 271/121 |
| 89731 | 3/1992 | Japan | 271/121 |
| 2195614 | 4/1988 | United Kingdom . | |

*Primary Examiner*—Boris Milef

*Attorney, Agent, or Firm*—Fitzpatrick, Cella, Harper & Scinto

[57] ABSTRACT

A sheet feeding apparatus has a sheet container which contains sheets and is removably mounted to a main body of the sheet feeding apparatus, a separation device including a conveyer and a separation member are urged against the conveyer with a predetermined separating pressure to separate the sheets fed out from the sheet container one by one, and a pressure increasing unit for increasing contact pressure between the conveyer and the separation device above the predetermined separating pressure. The pressure increasing unit increases the contact pressure until the mounting of the sheet container to the body of the sheet feeding apparatus is completed so that, even if the sheet container is inserted into the sheet feeding apparatus vigorously, the sheets are prevented from entering between the conveyer and the separation member, thus preventing poor sheet separation.

7 Claims, 8 Drawing Sheets

SHEET FEEDING APPARATUS WITH ADJUSTMENT OF PRESSURE BETWEEN SHEET CONVEY MEANS AND SHEET SEPARATION MEMBER

BACKGROUND OF THE INVENTION

1. Field of the Invention

The present invention relates to a sheet feeding apparatus for feeding a sheet used with an image forming apparatus such as an electrophotographic copying machine and the like.

2. Related Background Art

Nowadays, various information processing equipments have been proposed in dependence upon progress of information processing systems. Among them, recording apparatuses such as facsimiles, printers and the like have been widely used not only in offices but also in general homes.

FIG. 7 is a sectional view of a facsimile system to which a conventional sheet feeding apparatus is applied. A cassette 142 to which recording sheets (sheet materials) S are housed is mounted to a predetermined position of the facsimile system, and there are provided a recording sheet separating portion 143 comprising a pick-up roller 143*a* and a separation piece 143*b* which serve to separate the recording sheets S one by one, a sheet supply roller pair 145 comprising a pair of feed rollers 145*a*, 145*b* for conveying the separated recording sheet Sa, a recording portion 144 comprising a sheet feed roller 146 and an ink jet cartridge 147 having an ink jet head and an ink tank, and a sheet discharge roller pair 148 comprising a pair of sheet discharge rollers 148*a*, 148*b* for discharging the recording sheet S on which an image was recorded.

However, in the above-mentioned conventional art, in order to always contact the recording sheet stack S in the cassette 142 with the pick-up roller 143*a*, as shown in FIG. 8A, an intermediate plate 149 is always biased upwardly toward the pick-up roller. Further, an upper surface of a front wall 142*a* of the cassette 142 is positioned slightly lower than an upper surface of the sheet stack S.

Thus, if the cassette 142 containing the recording sheets S is mounted to the predetermined position of the facsimile system vigorously, as shown in FIG. 8B, several recording sheets S positioned above the upper surface of the front wall 142*a* of the cassette are advanced forwardly by inertia force, thereby forcing down the separation piece 143*b* for separating the recording sheets S one by one and entering the recording sheets between the pick-up roller 143*a* and the separation piece 143*b* to cause poor separation.

This is caused when separation pressure (contact pressure between the pick-up roller 143*a* and the separation piece 143*b*) for separating the recoding sheets S cannot prevent the recording sheets S from entering between the pick-up roller 143*a* and the separation piece 143*b* due to the great inertia force of the recording sheets S.

SUMMARY OF THE INVENTION

An object of the present invention is to solve the above-mentioned problem caused when a cassette is pushed into an image forming apparatus vigorously. That is to say, the object of the present invention is to prevent occurrence of a problem that poor sheet supply is caused by entering bundled sheets between a convey means and a separation member when the cassette is pushed into an image forming apparatus vigorously.

According to one aspect of the present invention, there is provided a sheet feeding apparatus comprising sheet containing means which can contain sheets and which can removably be mounted to a body of the sheet feeding apparatus, separation means including a convey means and a separation member urged against the convey means with predetermined separating pressure and adapted to separate the sheets fed out from the sheet containing means mounted on the body of the sheet feeding apparatus one by one, and pressure increasing means for increasing a contact pressure between the convey means and the separation member above the predetermined separating pressure. Wherein the pressure increasing means increases the contact pressure until the mounting of the sheet containing means to the body of the sheet feeding apparatus is completed.

According to another aspect of the present invention, there is provided a sheet feeding apparatus comprising sheet containing means which can contain sheets and which can removably be mounted to a body of the sheet feeding apparatus, separation means including a convey means and a separation member urged against the convey means with predetermined separating pressure and adapted to separate the sheets fed out from the sheet containing means mounted on the body of the sheet feeding apparatus one by one, and pressure increasing means for increasing a contact pressure between the convey means and the separation member above the predetermined separating pressure. Wherein the pressure increasing means increases the contact pressure when the sheet containing means is shifted forwardly from a mounting position of the sheet feeding apparatus in a mounting direction.

With this arrangement, even if the sheet containing means is pushed into the sheet feeding apparatus vigorously, bundled sheets are prevented from entering between the convey means and the separation member. Consequently, occurrence of poor sheet supply can be prevented, thereby separating and feeding the sheets one by one without fail.

DETAILED DESCRIPTION OF THE PREFERRED EMBODIMENTS

The present invention will now be explained in connection with embodiments thereof with reference to the accompanying drawings.

Figure 1:
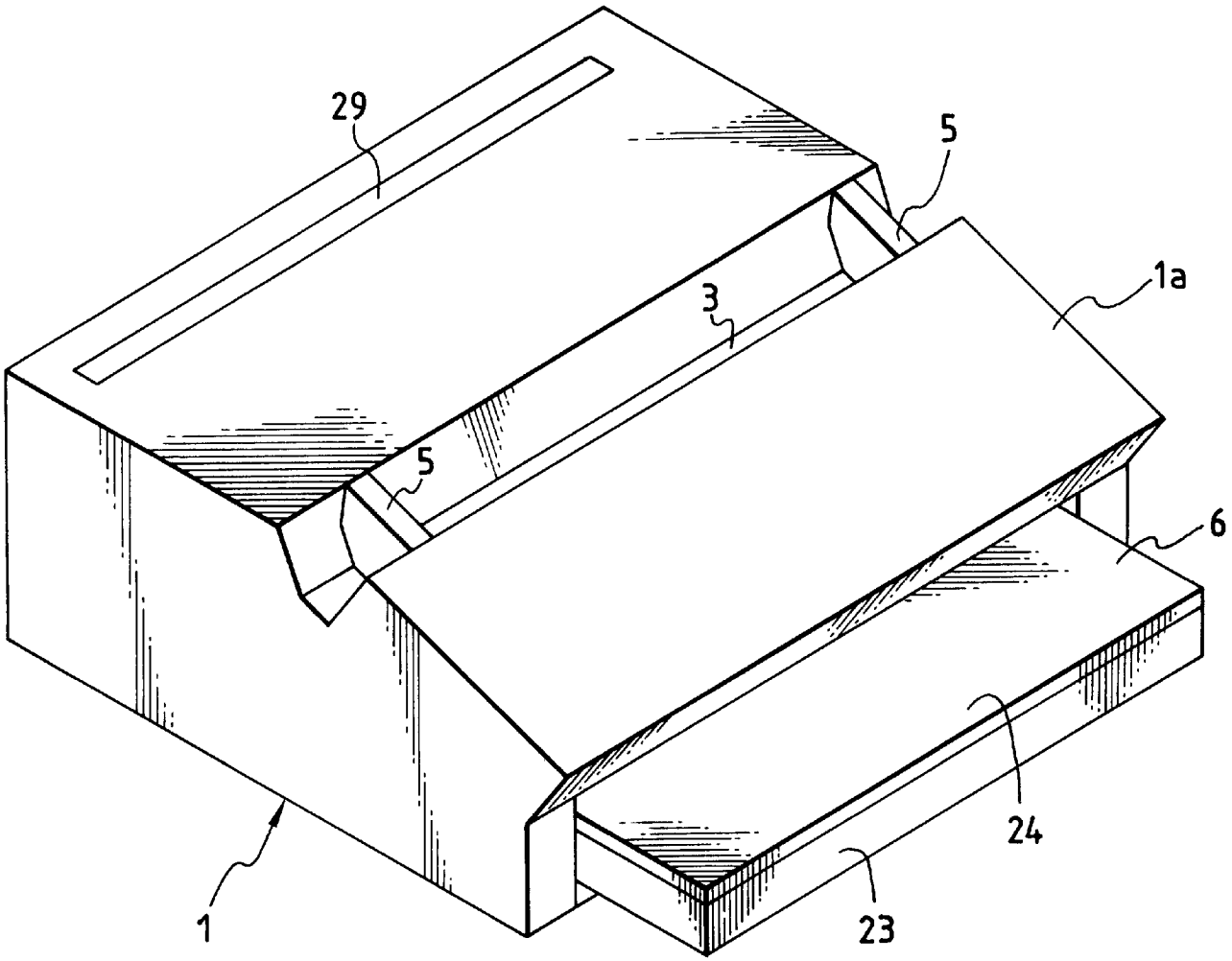
FIG. 1 is a perspective view of a facsimile system to which a sheet feeding apparatus according to a preferred embodiment of the present invention is applied.
Figure 2:
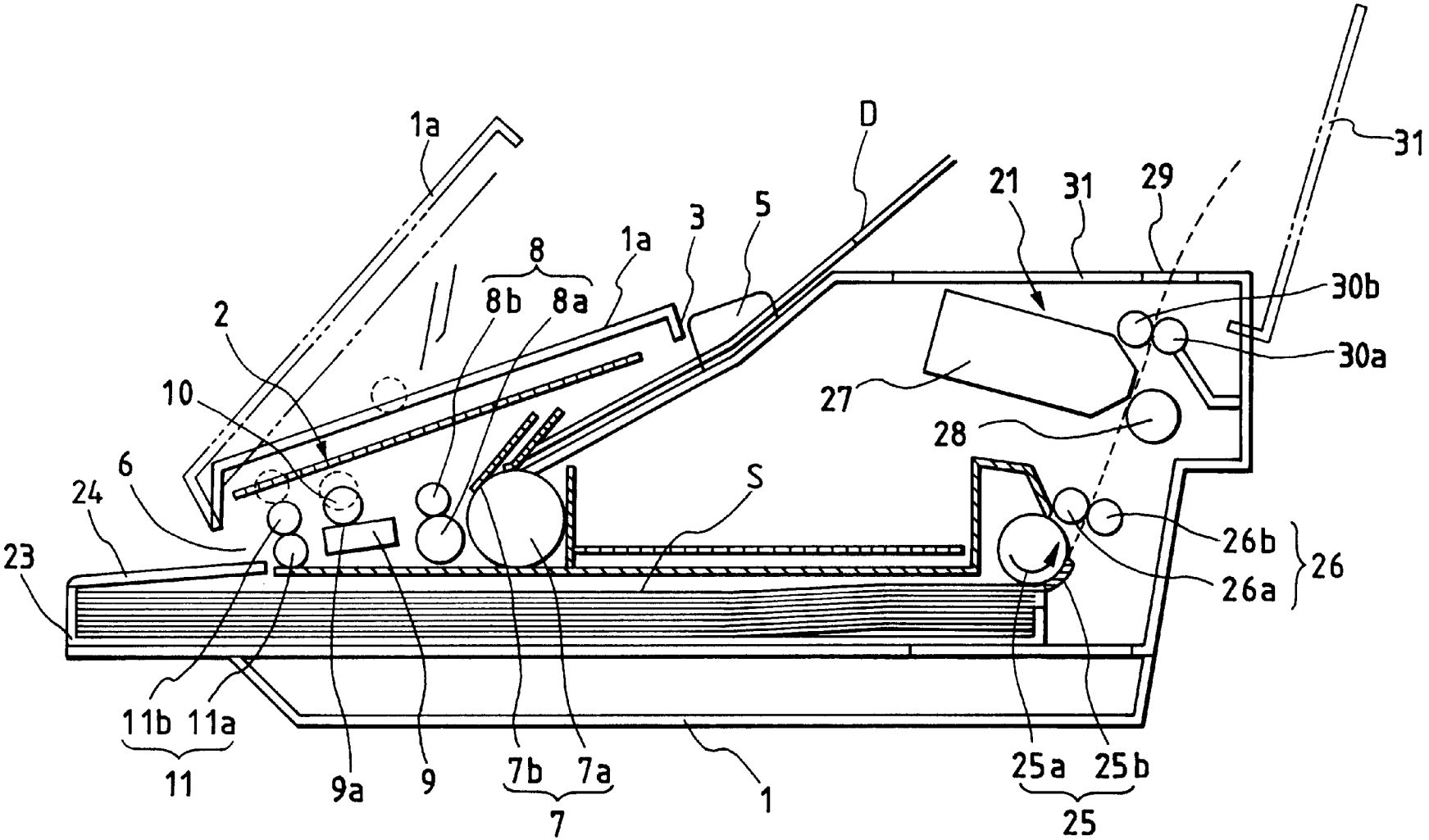
FIG. 2 is a sectional view of the facsimile system of FIG. 1.
Figure 3:
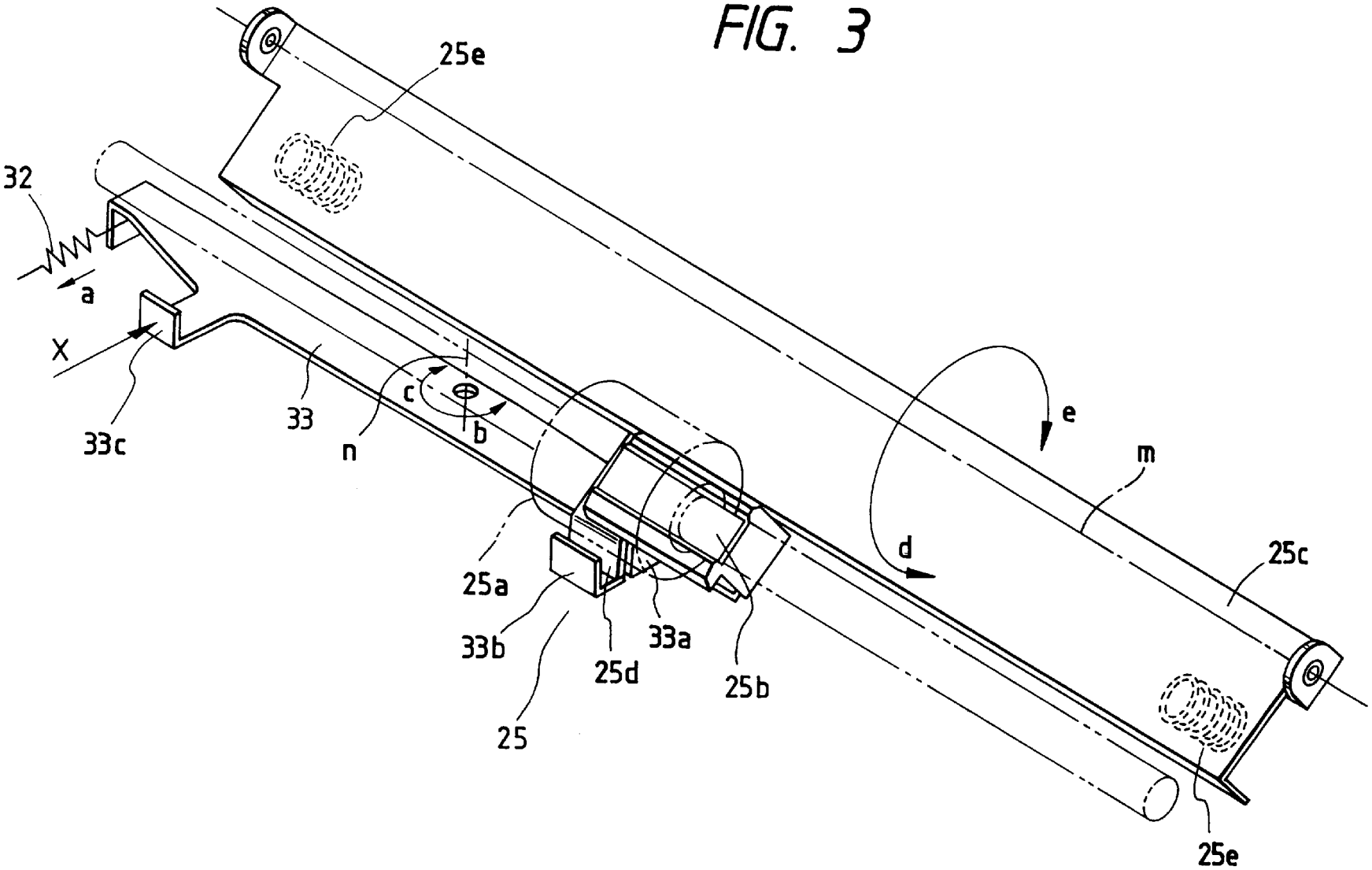
FIG. 3 is a perspective view of the sheet feeding apparatus.

FIG. 1 is a perspective view of a facsimile system to which a sheet feeding apparatus according to a preferred embodiment of the present invention is applied and FIG. 2 is a sectional view of the facsimile system. FIG. 3 is a perspective view showing a separating portion of the sheet feeding apparatus.

First of all, explaining the entire construction of the facsimile system with reference to FIG. 2, a body 1 of the system has an upper cover la inclined so that one end (left end in FIG. 2) of the cover is lower than the other end, thereby making the system compact totally. An original reading portion 2 provided at one end (left end in FIG. 2) of the facsimile system has an original insertion opening 3, and an original guide 5 slidable along a widthwise direction of an original D in order to regulate a side edge of the original at the original insertion opening 3.

Further, in an original convey path of the original reading portion 2 (i.e. between the original insertion opening 3 and an original discharge opening 6 positioned below the left end of the upper cover 1*a* of the system body 1), there are arranged an ADF (automatic document feeder) portion 7 adapted to separate the originals D sent from the original guide 5 one by one and comprising an ADF roller 7*a* and an urging member 7*b* urged against the ADF roller 7*a*, a sheet feed portion 8 comprising a pair of feed rollers 8*a*, 8*b* for feeding the original separated at the ADF portion 7, an image sensor 9 of contact type acting as a reading means for reading image information on the original sent from the sheet feed portion 8, a CS roller 10 acting as a contacting means opposed to the image sensor 9 of contact type and adapted to convey the original while closely contacting the original D against the sensor 9 with a predetermined urging force at a reading position 9*a*, and a discharge portion 11 comprising a pair of discharge rollers 11*a*, 11*b* for discharging the original 4 (which was read) through the original discharge opening 6.

Next, a reading operation of the facsimile system will be explained.

After the originals D are set along the original guide 5, when a reading start signal is inputted by an operation switch, a drive motor (not shown) is driven to rotate the ADF roller 7*a*, feed roller 8*a*, discharge roller 11*a* and CS roller 10, with the result that the originals D are separated one by one at the ADF portion 7 and the separated original is sent to the sheet feed portion 8. When a tip end of the original D is detected by an original tip end detection sensor (DES), the drive motor is stopped to temporarily stop the ADF roller 7*a*, feed roller 8*a*, discharge roller 11*a* and CS roller 10.

Then, a predetermined time period is elapsed, the drive motor is driven again to rotate the ADF roller 7*a*, feed roller 8*a*, discharge roller 11*a* and CS roller 10 again. After the rollers 7*a*, 8*a*, 11*a*, 10 are rotated, while the tip end of the original D is being conveyed to the reading position 9*a* of the sensor 9 of contact type, a peripheral surface (white as reference color) of the CS roller 10 is read by the sensor 9 of contact type.

Then, when the tip end of the original D is sent to the reading position 9*a* of the sensor 9 of contact type, the image information on the original D is read. In this case, the original D is urged against the reading position 9*a* of the sensor 9 of contact type from the above by means of the CS roller 10 so that a reading line of the sensor 9 of contact type is aligned with a generatrix of the CS roller 10, with the result that the original D is not floating from the reading position 9*a*, thereby reading the image information with high accuracy.

When the reading of the original D is finished in this way, the original D is sent to the discharge portion 11 by the CS roller 10 also acting as the original convey means and then is discharged out of the system through the sheet discharge opening 6 by the pair of discharge rollers 11*a*, 11*b*. In this way, the reading of the information on the single original is completed.

If the original being read is jammed, as shown by the two dot and chain line in FIG. 2, the upper cover 1*a* is opened by rocking the cover around a fulcrum disposed near the sheet discharge opening. As a result, the urging member 7*b*, feed roller (back-up roller) 8*b*, CS roller 10 and discharge roller (back-up roller) 11*b* held by a member (not shown) attached to the upper cover 1*a* are shifted to positions shown by the two dot and chain line in FIG. 2 to open a sheet convey path. Accordingly, the jammed original D can easily be removed.

Next, a construction of a recording portion will be explained.

A recording portion 21 is provided at the other end (right end in FIG. 2) of the original reading portion 2 of the facsimile system 1. A cassette 23 acting as a containing means for containing recording sheet S as sheet materials is mounted to the facsimile system 1. Further, since a cassette cover 24 is made of transparent material, a remaining amount of recording sheets S can be ascertained without retracting the cassette 23 from the facsimile system 1. In the proximity of one end (right end in FIG. 2) of the recording sheet stack S, there are arranged a recording sheet separating portion 25 comprising a pick-up roller (convey means) 25*a* and separation piece (separation member) 25*b* urged against the pick-up roller 25*a* by a spring (not shown) or other elastic member such as a rubber member, a sheet feed portion 26 comprising a pair of feed rollers 26*a*, 26*b* for feeding the recording sheet S separated at the recording sheet separating portion 25, an ink jet cartridge (recording means) 27 for recording an image on the recording sheet S conveyed from the sheet feed portion 26, a convey roller 28 for conveying the recording sheet S to a position substantially opposed to the ink jet cartridge 27, and a sheet discharge portion 30 comprising a pair of discharge rollers 30*a*, 30*b* for discharging the recording sheet S on which the image was recorded through a recording sheet discharge opened 29.

Next, a recording operation of the recording portion 21 will be explained.

When the reading start signal is inputted by an operation swtich after the original D are set along the original guide 5, or when an image receiving signal is inputted through a telephone line, the drive motor is driven to rotate the pick-up roller 25*a* to send the recording sheets S to the separation piece (separation member) 25*b*, where the recording sheets S are separated one by one by the separating portion 25 comprising the pick-up roller 25*a* and the separation piece 25*b*, and the separated recording sheet is sent to the sheet feed portion 26. Incidentally, the separation piece 25*b* is made of high friction material.

Further, before the recording sheet S reaches the sheet feed portion 26, another drive motor is driven to rotate the feed roller 26*a*, convey roller 28 and discharge roller 30*a*, thereby conveying the recording sheet S.

Then, a tip end of the recording sheet S is detected by a recording sheet tip end sensor (PE sensor) disposed between the feed roller 26*a* and the convey roller 28. After the tip end of the sheet is detected by the PE sensor, the recording sheet S is advanced by a predetermined distance and the recording is started by the ink jet cartridge. When the recording of the recording sheet S is finished, the recording sheet is discharged out of the facsimile system by the pair of discharge rollers 30*a*, 30*b*. In this way, the recording operation of the image information regarding the single recording sheet is completed.

Further, as shown by the two dot and chain line, a record cover 31 can be opened around an upper end (FIG. 2) of the system so that the ink jet cartridge can easily be exchanged.

Next, an operation for mounting the cassette 23 to the facsimile system 1 will be explained with reference to FIG. 3 which is a perspective view showing the separation piece 25*b* and therearound.

Figure 4A:
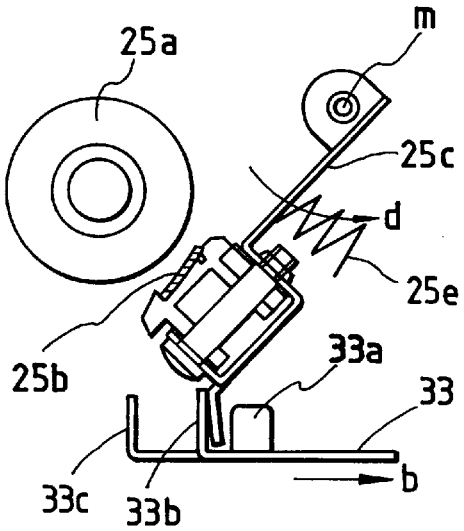
FIGS. 4A to 4C are schematic views for explaining an operation of a recording sheet separating portion of the sheet feeding apparatus.

The separation piece 25*b* is held by a support plate 25*c* rockable around a longitudinal axis m in directions d and e. On the other hand, a jam releasing plate 33 acting as an pressure increasing means is normally biased toward a direction a by a spring 32 to rotate the plate 33 around an axis n in a direction b, with the result that the support plate 25*c* is rotated by a bent portion 33*b* of the jam releasing plate in the direction d (FIG. 4A). As a result, the separation piece 25*b* is separated from the pick-up roller 25*a*, so that, if the recording sheet S is jammed between the separation piece and the pick-up roller, the sheet can easily be removed. Incidentally, although the support plate 25*c* is biased toward the direction e by springs 25*e*, since a spring force of the spring 32 is set to be greater than spring forces of the springs 25*e*, the separation piece 25*b* can be separated from the pick-up roller 25*a*.

Figure 4B:
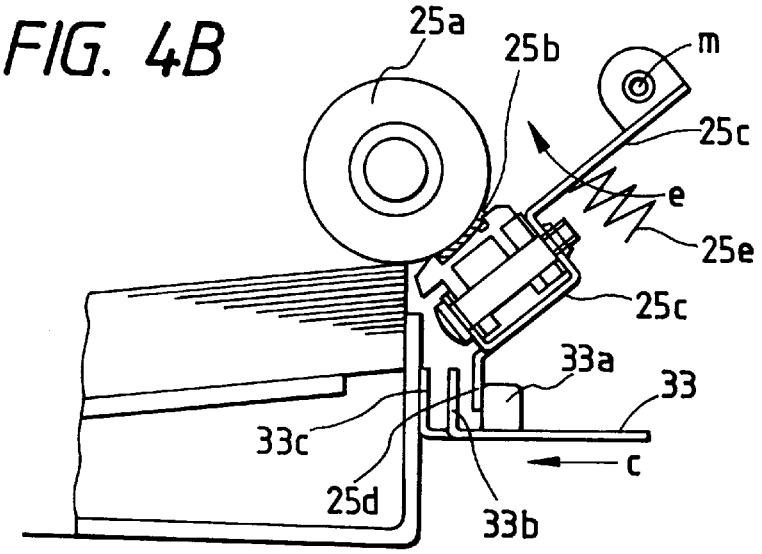

Then, after the cassette 23 is mounted to the facsimile system, when an urging piece 33*c* of the jam releasing plate 33 is pushed toward a direction X in opposition to the spring force of the spring 32, the jam releasing plate 33 is rotated around the axis in a direction c so that a bent portion 25*d* of the support plate 25*c* is urged by a bent portion 33*a* of the jam releasing plate 33 around the axis in the direction e, thereby increasing the contacting force between the pick-up roller 25*a* and the separation piece 25*b*. Consequently, even if the cassette 23 is inserted into the facsimile system vigorously, the separation piece 25*b* can be prevented from being pushed down by the bundled recording sheets S (FIG. 4B). However, in this condition, the cassette 23 is further advanced from a normal or proper mounting position.

Figure 4C:
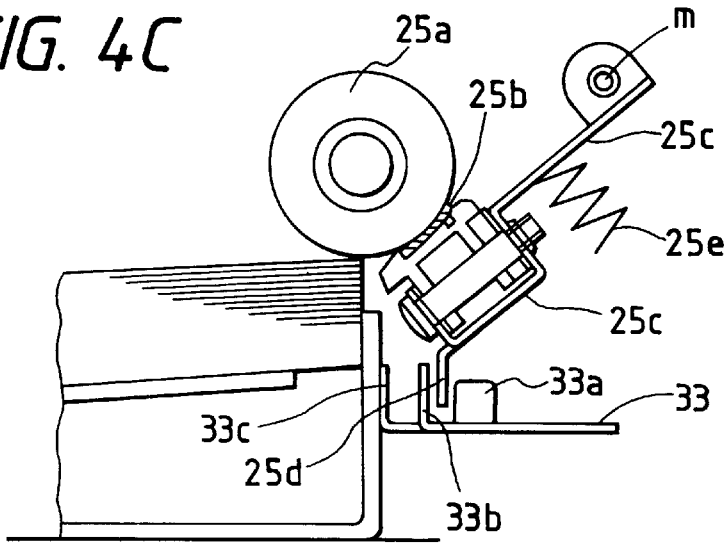

When the mounting of the cassette 23 to the facsimile system is completed, that is, when the operator releases his hand from the cassette 23, the cassette 23 is slightly returned to the proper mounting position (FIG. 4C) by the spring force of the spring 32. In this condition, the support plate 25*c* is not regulated by the jam releasing plate 33 to provide the predetermined separating pressure (contact pressure) between the pick-up roller 25*a* and the separation piece 25*b*, thereby enabling to separate the recording sheets S one by one properly. Incidentally, although the cassette 23 is biased toward a dismounting direction by the spring 32 at the mounting position, it is held in the mounting position by an appropriate regulating means (not shown).

Second Embodiment

In the above-mentioned first embodiment, while an example that the jam releasing plate 33 and the support plate 25*c* are mechanically shifted in synchronous with the movement (mounting movement) of the cassette 23 to temporarily increase the contact force between the pick-up roller 25*a* and the separation piece 25*b* so that, if the cassette 23 is inserted into the facsimile system vigorously, the separation piece 25*b* can be prevented from being pushed down by the bundled recording sheets S was explained, the same technical advantage can be obtained by using an electrical technique in place of the mechanical movement.

Figure 5A:
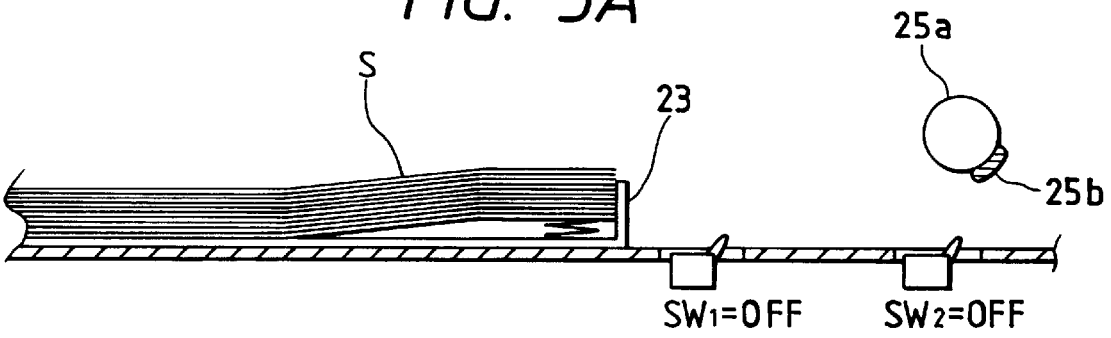
FIGS. 5A to 5C are schematic views showing a cassette mounting operation, according to another embodiment of the present invention.
Figure 5B:
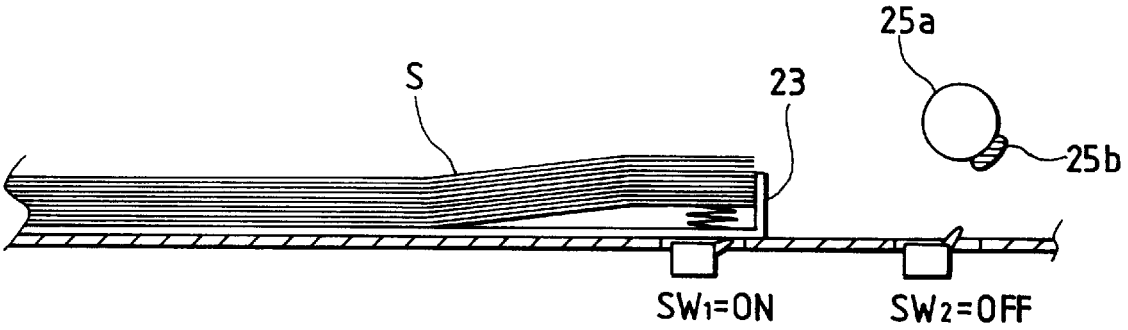
Figure 5C:
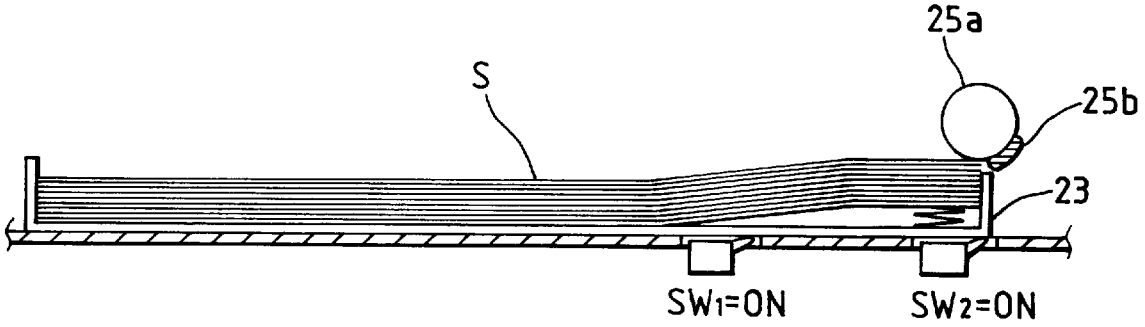

That is to say, as shown in FIGS. 5A to 5C, the presence/absence of the cassette 23 is detected by a micro-switch SW1, and a micro-switch SW2 detects whether the cassette 23 is mounted to the proper mounting position. On the basis of conditions of the micro-switches SW1, SW2, the separation piece 25*b* is pulled toward the pick-up roller 25*a* by a solenoid (pressure increasing means) 34, thereby controlling the contact pressure between the pick-up roller 25*a* and the separation piece 25*b*.

Now, this electrical technique will be fully described.

Figure 6A:
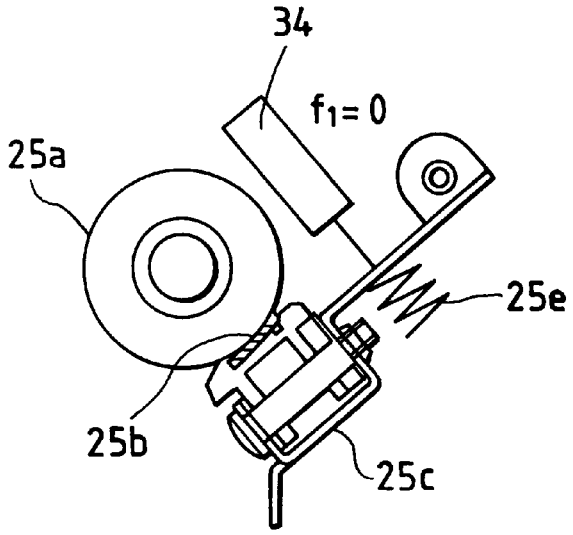
FIGS. 6A to 6C are schematic views showing a recording sheet separating portion of a sheet feeding apparatus according to a further embodiment of the present invention.

(1) When the cassette 23 is not mounted:

As shown in FIG. 5A, when the micro-switches SW1, SW2 are both turned OFF, it is judged that the cassette is not mounted on the facsimile system. In this condition, the solenoid 34 is not operated, and the contact pressure f between the pick-up roller 25*a* and the separation piece is defined by a force F from the springs 25*e* (f=F) (FIG. 6A).

Incidentally, in this embodiment, even when the casseete 23 is not mounted, although the separation piece 25*b* is urged against the pick-up roller 25*a* due to the presence of the springs, the separation piece is not necessarily urged against the pick-up roller when the cassette is not mounted.

Figure 6B:
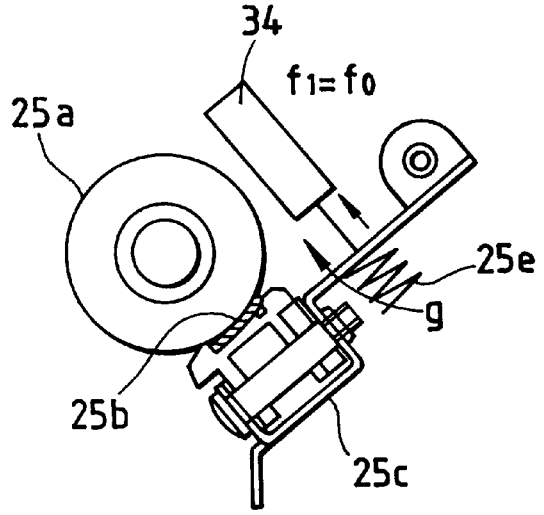

(2) When the cassette 23 is mounted:

As shown in FIG. 5B, when the micro-switch SW1 is turned ON and the micro-switch SW2 is turned OFF, it is judged that the cassette is mounted on the facsimile system. In this condition, the contact pressure f between the pick-up roller 25*a* and the separation piece 25*b* is defined by not only the force F from the springs but also a force $f_1$ ($f=f_0$) of the solenoid 34 for pulling the support plate 25*c* and accordingly the separation piece 25*b* toward the pick-up roller 25*a* in a direction g ($f=F+f_0$), with the result that, even if the cassette 23 is inserted into the facsimile system vigorously, the separation piece 25*b* can be prevented from being pushed down by the bundled recording sheets S (FIG. 6B)

(3) When the mounting of the cassette 23 is completed:

As shown in FIG. 5C, when the micro-switches SW1, SW2 are both turned ON, it is judged that the mounting of the cassette is completed. In this condition, the force $f_1$ of the solenoid 34 disappears ($f_1=f_0$), and, thus, the contact pressure (separating pressure) f between the pick-up roller 25*a* and the separation piece 25*b* is kept to the optimum value (f=F) for separating the recording sheets S one by one (FIG. 6C).

Figure 6C:
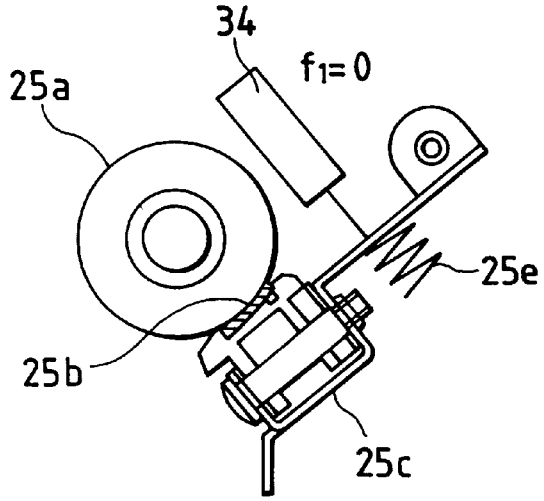
Figure 7:
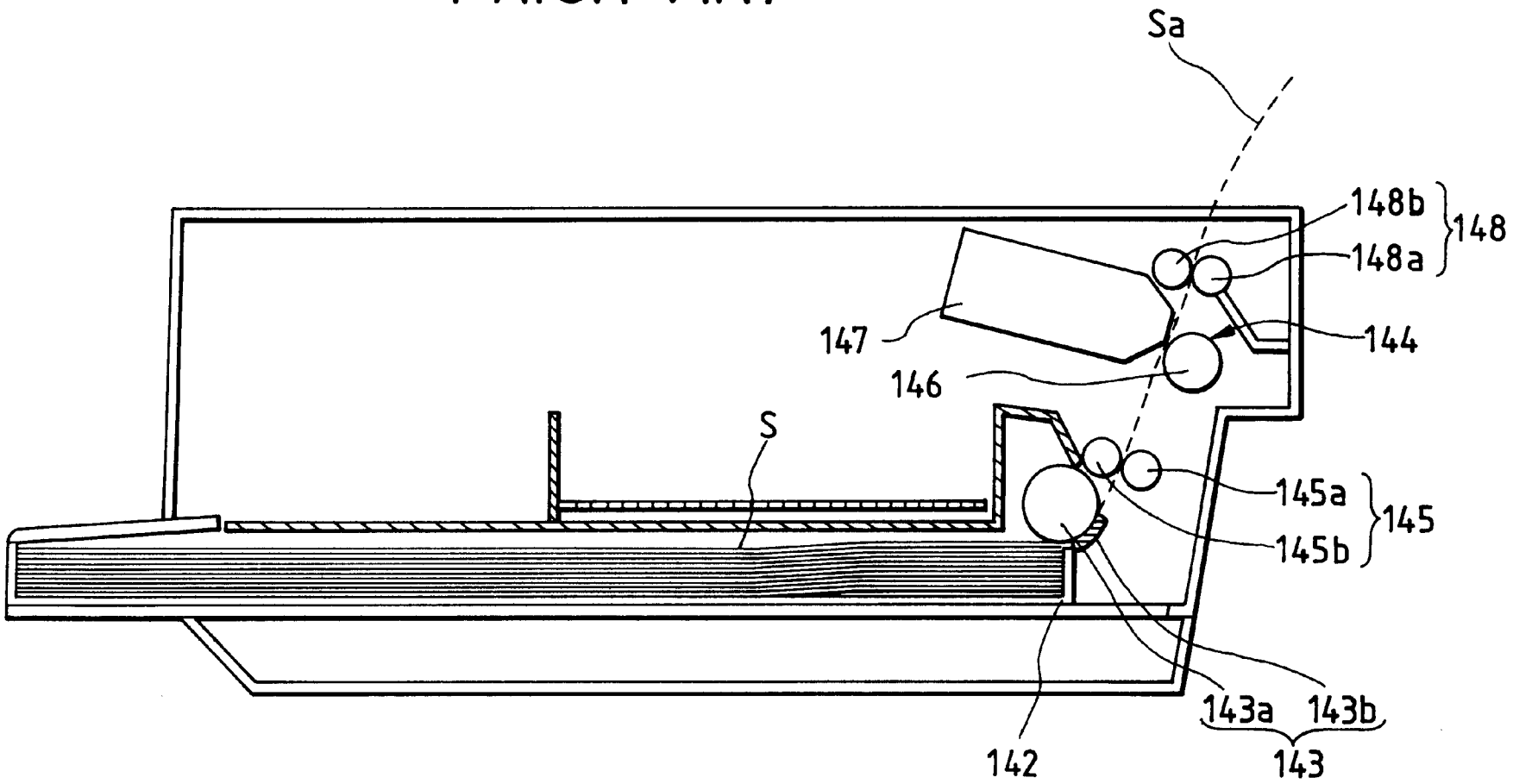
FIG. 7 PRIOR ART
FIG. 7 is a sectional view of a facsimile system to which a conventional sheet feeding apparatus is applied.
Figure 8A:
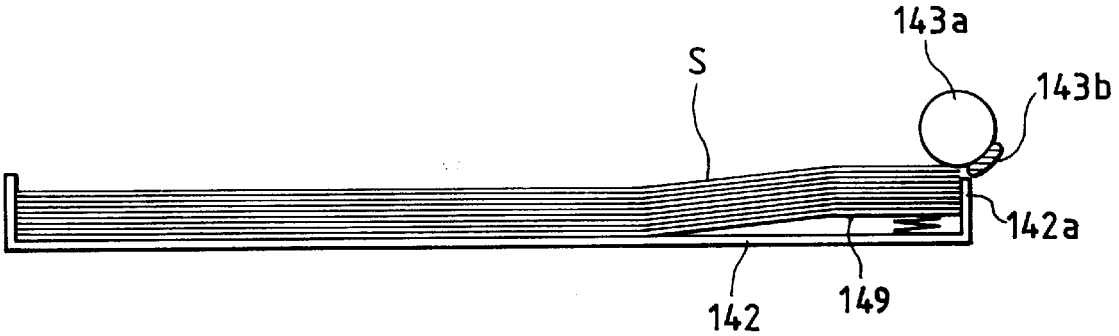
FIG. 8A PRIOR ART
FIGS. 8A and 8B are schematic views showing movement of sheets in the conventional sheet feeding apparatus.
Figure 8B:
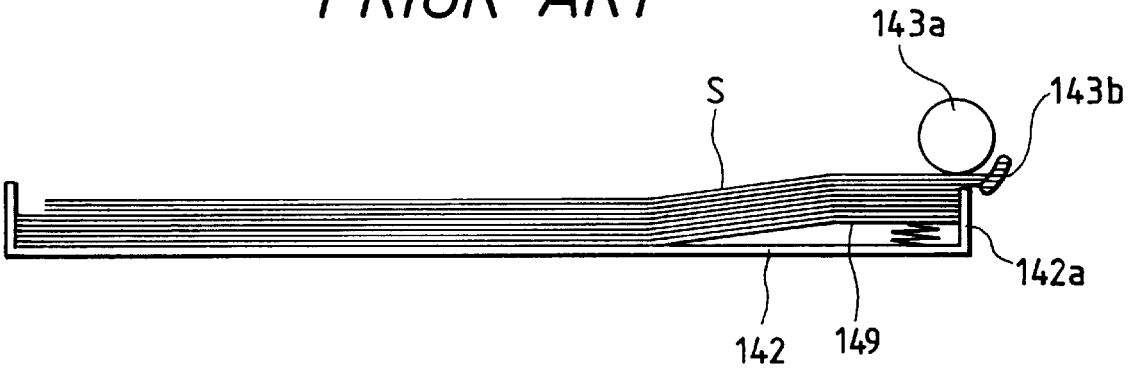
FIG. 8B PRIOR ART

In this embodiment, the condition that the cassette 23 is not mounted (FIG. 6A) is the same as the condition that the mounting of the cassette 23 is completed (FIG. 6C).

While the present invention was fully explained in connection with embodiments thereof, the present invention is not limited to such embodiments. For example, in the above-mentioned emodiments, while the present invention was applied to the separation means for separating the recording sheets one by one, the present invention may be applied to a separation means for separating originals or other sheets one by one.

Further, in the above-mentioned embodiments, while an example that the supplying and separation of the sheets are effected by the pick-up roller was explained, the supplying and separation of the sheets may be effected by discrete rollers and the like.

In addition, in the above-mentioned embodiments, while the separation piece was used as the separation means, in place of the separation piece, a reverse rotation roller (i.e. so-called retard roller) may be used.

What is claimed is:

1. A sheet feeding apparatus comprising:

sheet containing means for containing sheets and being mounted at a mount position of a main body of the sheet feeding apparatus;

separation means disposed at a side in a mounting direction of said sheet containing means and having sheet convey means and a sheet separation member urged against said sheet convey means with a predetermined separating pressure; and pressure increasing means for increasing a contact pressure between said sheet convey means and said sheet separation member over the predetermined separating pressure to prevent the sheets from inserting between said sheet convey means and said sheet separation member when said sheet containing means is advanced in the mounting direction from the mount position to an advanced position of the main body, and returning it to the predetermined separating pressure when said sheet containing means is returned to the mount position from the advanced position, said separation means separating the sheets fed out from said sheet containing means at the mount position one by one with the predetermined separating pressure.

2. A sheet feeding apparatus according to claim 1, wherein said separation member is abuttable against and separatable from said convey means, and is urged against said convey means with said predetermined separating pressure by an elastic means.

3. A sheet feeding apparatus according to claim 1, wherein said pressure increasing means has a rockable member rockably provided on the main body, and, when said sheet containing means is mounted to the main body, said sheet containing means urges one end of said rockable member to rock it, thereby urging said separation member so as not to move in a direction away from said convey means at the other end of said rockable member to thereby increase the contact pressure.

4. A sheet feeding apparatus according to claim 1, wherein said separation means is arranged proximate a downstream end of said sheet containing means mounted to the body of the sheet feeding apparatus.

5. A sheet feeding apparatus according to claim 1, wherein said convey means is abutted against an uppermost sheet among the sheets contained in said sheet containing means to feed out the sheet or sheets.

6. A sheet feeding apparatus according to claim 1, further comprising a spacing means for separating said convey means and said separation member from each other when said sheet containing means is not mounted to the body of the sheet feeding apparatus.

7. An image forming apparatus comprising:

sheet containing means for containing sheets and being mounted at a mount position of a main body of the sheet feeding apparatus;

separation means having sheet convey means and a sheet separation member urged against said sheet convey means with a predetermined separating pressure;

pressure increasing means for increasing a contact pressure between said sheet convey means and said sheet separation member over the predetermined separating pressure to prevent the sheets from inserting between said sheet convey means and said sheet separation member when said sheet containing means is advanced in the mounting direction from the mount position to an advanced position of the main body, and returning it to the predetermined separating pressure when said sheet containing means is returned to the mount position from the advanced position;

said separation means separating the sheets fed out from said sheet containing means at the mount position one by one with the predetermined separating pressure; and image forming means for forming an image on the sheet separated by said separation means.

* * * * *

UNITED STATES PATENT AND TRADEMARK OFFICE

CERTIFICATE OF CORRECTION

PATENT NO. : 5,938,188

DATED : August 17, 1999

INVENTOR(S) : HIDEAKI NAGAHARA

It is certified that error appears in the above-identified patent and that said Letters Patent is hereby corrected as shown below:

COLUMN 1:

Line 14, "in dependence" should read --depending--; and
Line 17, "homes." should read --in homes.--.

COLUMN 3:

Line 9, "compact totally." should read --totally compact.--.

COLUMN 5:

Line 14, "an" should read --a--.

Signed and Sealed this

Second Day of May, 2000

*Attest:*

Q. TODD DICKINSON

*Attesting Officer*

*Director of Patents and Trademarks*